US009385443B2

(12) United States Patent
Moser

(10) Patent No.: US 9,385,443 B2
(45) Date of Patent: Jul. 5, 2016

(54) CONNECTION OR CONNECTING TERMINAL COMPRISING A PUSHBUTTON FOR ACTUATING A SPRING ELEMENT

(71) Applicant: Tridonic GmbH & Co KG, Dombirn (AT)

(72) Inventor: Peter Moser, Stans (AT)

(73) Assignee: TRIDONIC GMBH & CO KG, Dornbirn (AT)

( * ) Notice: Subject to any disclaimer, the term of this patent is extended or adjusted under 35 U.S.C. 154(b) by 0 days.

(21) Appl. No.: 14/414,863

(22) PCT Filed: Jul. 1, 2013

(86) PCT No.: PCT/AT2013/000113

§ 371 (c)(1),
(2) Date: Jan. 14, 2015

(87) PCT Pub. No.: WO2014/015352

PCT Pub. Date: Jan. 30, 2014

(65) Prior Publication Data

US 2015/0194745 A1 Jul. 9, 2015

(30) Foreign Application Priority Data

Jul. 27, 2012 (AT) ..... GM 310/2012

(51) Int. Cl.
*H01R 12/00* (2006.01)
*H01R 4/48* (2006.01)
(Continued)

(52) U.S. Cl.
CPC ..... *H01R 4/4836* (2013.01); *H01R 12/515* (2013.01); *H01R 12/53* (2013.01); *H01R 12/7076* (2013.01)

(58) Field of Classification Search
CPC .. H01R 12/53; H01R 12/515; H01R 12/7076; H01R 4/4836; H01R 24/28; H01R 12/57; H01R 13/15
USPC ..... 439/55
See application file for complete search history.

(56) References Cited

U.S. PATENT DOCUMENTS 8,292,677 B2 * 10/2012 Gassauer ..... H01R 13/15 439/729
8,485,841 B2 * 7/2013 Schrader ..... H01R 4/4827 439/441

(Continued)

FOREIGN PATENT DOCUMENTS

DE 1984159 U 4/1968
DE 29721216 U1 3/1999

(Continued)

*Primary Examiner* — Jean F Duverne
(74) *Attorney, Agent, or Firm* — Volpe and Koenig, P.C.

(57) ABSTRACT

The invention relates to a contacting or connection terminal for electrically connecting at least one conductor (26) and at least one electrical contact body, said terminal having a housing (2) in which the contact body is arranged, and at least one pressing member (3), wherein the electrical contact body comprises a clamping conductor connector for the at least one electrical conductor (26) and has at least one punched part (5), said punched part (5) having at least one spring element (6) for the clamping conductor connector. An actuation of the pressing member (3) acts on the spring element (6) and enables an opening of the clamping conductor connector, wherein the opening path of the clamping conductor connector (WF), due to actuation of the pressing member (3), is greater than the pressing member path (WD), at least in one portion. The invention also relates to a circuit board and a luminaire with a contacting or connection terminal according to the invention.

10 Claims, 5 Drawing Sheets

(51) Int. Cl.

| | |
|---|---|
| ***H01R 12/51*** | (2011.01) |
| ***H01R 12/53*** | (2011.01) |
| ***H01R 12/70*** | (2011.01) |

(56) References Cited

U.S. PATENT DOCUMENTS

| | | | | |
|---|---|---|---|---|
| 9,099,795 | B2 * | 8/2015 | Hanses | H01R 9/26 |
| 2007/0006558 | A1 * | 1/2007 | Ramm | H01R 13/193 55/385.6 |
| 2007/0178747 | A1 * | 8/2007 | Schrader | H01R 4/4827 439/441 |
| 2009/0035998 | A1 | 2/2009 | Schrader | |
| 2011/0217882 | A1 | 9/2011 | Gassauer | |
| 2011/0250775 | A1 | 10/2011 | Bies et al. | |
| 2013/0095688 | A1 | 4/2013 | Koellmann | |

FOREIGN PATENT DOCUMENTS

| | | | |
|---|---|---|---|
| DE | 102008039232 | A1 | 2/2010 |
| DE | 102010014143 | A1 | 10/2011 |
| EP | 2020700 | A1 | 2/2009 |
| EP | 2445056 | A1 | 4/2012 |

* cited by examiner

Fig. 1a
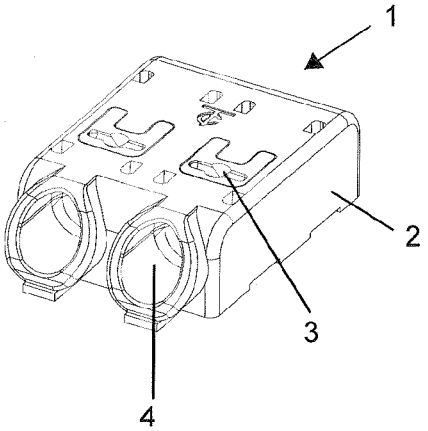
Fig. 1b
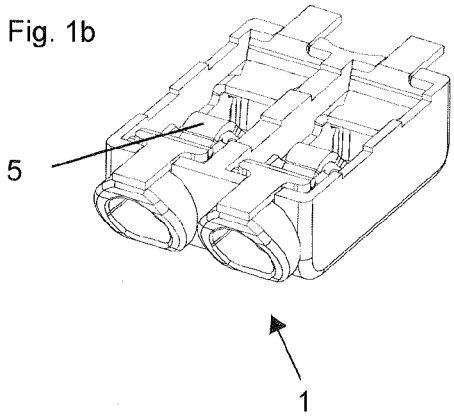
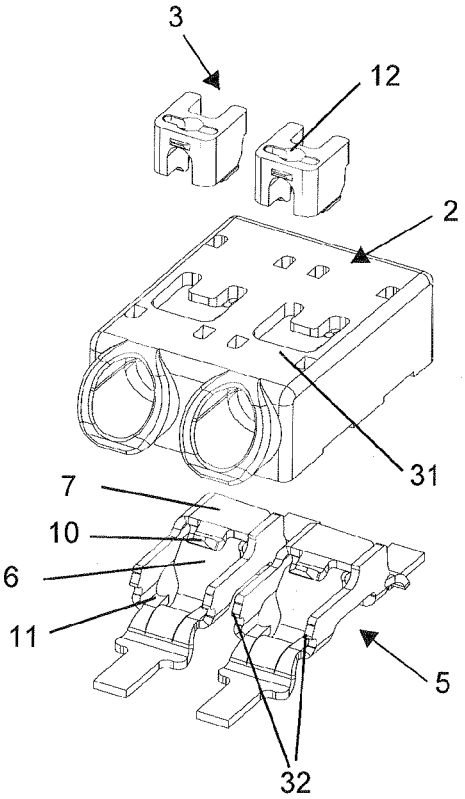
Fig. 2a
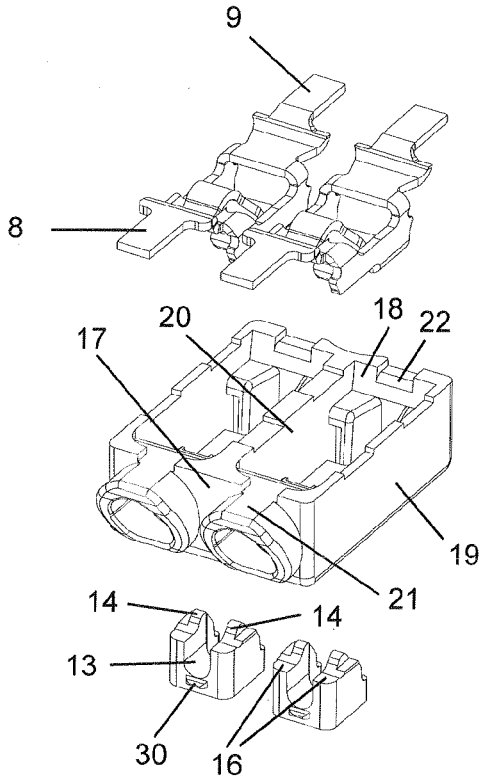
Fig. 2b

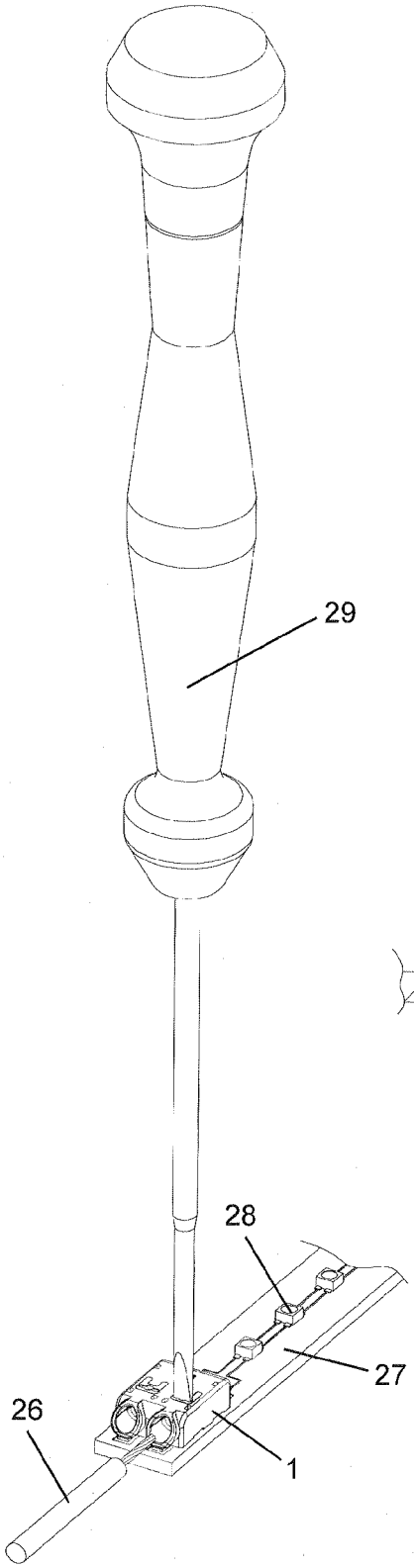
Fig. 3
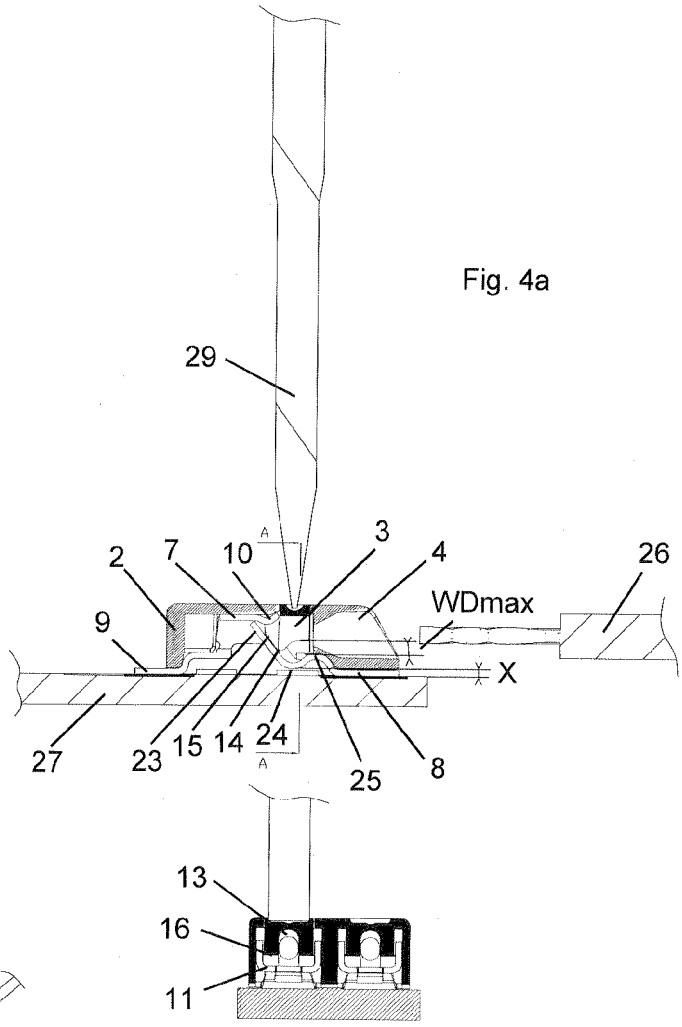
Fig. 4a
Fig. 4b

CONNECTION OR CONNECTING TERMINAL COMPRISING A PUSHBUTTON FOR ACTUATING A SPRING ELEMENT

FIELD OF THE INVENTION

The invention relates to a connection or connecting terminal for at least one electrical conductor and to a printed circuit board and a luminaire.

BACKGROUND

Connection or connecting terminals preferably having a small physical shape are used for applications with light-emitting diodes (LEDs).

The connection or connecting terminal described in DE 102010014143 A1 discloses a connection or connecting terminal comprising an insulating housing and at least one pushbutton, arranged on the insulating housing. Furthermore, a contact frame comprising a spring element is provided, wherein an actuation of the pushbutton takes effect on the spring element and opens a conductor clamping connection. The pushbutton arm extends along at least a subsection of two surfaces of the insulating housing which are arranged at an angle with respect to one another in order that sufficient opening force can be applied to the spring element over a short travel distance.

The invention is based on the object of configuring a connection or connecting terminal such that the connection or connecting terminal has a much smaller physical shape, primarily with a very low height, wherein secure clamping of rigid or flexible conductors with different diameters is ensured. It should also be possible for there to be simple handling during fitting and removal of the electrical conductor.

The objects are achieved in accordance with the invention by the features specified in the independent claims.

SUMMARY

The connection or connecting terminal for electrically connecting at least one conductor and at least one electrical contact body has a housing, in which the contact body is arranged, and at least one pushbutton, wherein the electrical contact body comprises a conductor clamping connection for the at least one electrical conductor, and wherein the electrical contact body has at least one punched part, wherein the punched part has at least one spring element for the conductor clamping connection, wherein an actuation of the pushbutton takes effect on the spring element and enables opening of the conductor clamping connection.

An essential feature of the connection or connecting terminal consists in that the opening travel of the conductor clamping connection owing to the actuation of the pushbutton is greater, at least in a subregion, than the pushbutton travel.

This provides the advantage that a sufficient opening travel of the conductor clamping connection can be achieved with a very low physical height of the connection or connecting terminal in order to be able to insert or release an electrical conductor. Various conductors, rigid and/or flexible conductors, with different diameters, preferably from 0.2 $mm^2$ to 0.5 $mm^2$, can also be used.

The configuration of the spring element may be essential for determining the opening travel of the conductor clamping connection. It is preferred that the spring element has an S shape or L shape with a spring limb.

It is thus possible to configure the spring limb to be longer and to achieve better spring properties or improved elastic recovery.

For this purpose, the pushbutton can be arranged so as to be guided in its actuation direction in the housing in order to be able to prevent a tipping movement of the pushbutton outside its actuation axis or actuation direction. Preferably, the pushbutton is guided in the manner of an elevator in the housing.

For example, the pushbutton can have a latching edge in order to be able to prevent the pushbutton from falling out of the housing.

In accordance with a preferred embodiment, the pushbutton can bear on the spring limb of the spring element, and an actuation of the pushbutton thereby takes effect directly on the spring limb.

Provision can also be made for the pushbutton to have a contact surface, which bears against the spring limb, at least in the unactuated state of the pushbutton.

For this purpose, the pushbutton can have a contact knob, which acts on the spring element on actuation of the pushbutton or transfers the actuation force on the spring element on actuation of the pushbutton and enables deformation of the spring element. The contact knob can pass through the punched part.

The spring element has a first resting region, which is supported on a mounting surface of the connection or connecting terminal, after a partial actuation of the pushbutton. A 2-point deformation of the spring element can be achieved during a release process as a result of this supporting arrangement.

It is preferred for the contact knob of the pushbutton to bear against the spring limb, but not in the region of the free end of the spring limb but more in the direction of the region of the resting region of the spring element.

For this purpose, the spring element can have a further resting region, which bears on the housing. This resting region preferably acts as support or bearing arrangement for the spring element.

In a first section, during actuation of the pushbutton, the entire spring element is moved uniformly in the actuation direction of the pushbutton until the first resting region of the spring element bears on a mounting surface of the connection or connecting element. The mounting surface may be a printed circuit board, for example. In this first section, the pushbutton travel corresponds to the opening travel of the conductor clamping connection, or a uniform ratio between the pushbutton travel and the opening travel of the conductor clamping connection is provided. The contact surface of the pushbutton preferably bears against the spring limb in this first section.

In a second section, on actuation of the pushbutton, once the spring element bears with its resting region on a mounting surface of the connection or connecting terminal, now only the spring limb is moved. Owing to the length of the spring limb or the available lever arm, a short pushbutton travel effects a relatively large opening travel of the conductor clamping connection. The contact surface of the pushbutton preferably no longer bears against the spring limb in this first section.

In addition, the pushbutton travel, on actuation of the pushbutton, can be limited by a stop in order to prevent the spring element or spring limb from bending over. The stop can be provided on the punched part or on the housing.

Preferably, the pushbutton can also act as conductor guide for the conductor, wherein a channel is provided in the pushbutton for the conductor. Therefore, the conductor can be located in a secure position in the conductor clamping connection.

The actuation of the pushbutton can preferably be performed by means of a tool, for example a screwdriver.

It is also advantageous if the punched part is formed in one piece or is formed from one material. However, the possibility of the punched part being formed in more than one piece should not be ruled out.

For this purpose, the stamped part can be latched in the housing, for example. Hooks can be provided on the contact frame of the punched part, which hooks are latched in the housing of the connection or connecting terminal.

The connection or connecting terminal according to the invention can be used, for example, as connection or connecting terminal for printed circuit boards. Owing to its small or low physical shape in terms of height and width, it can preferably be used in LED applications.

The connection or connecting terminal according to the invention can preferably be a screwless connection or connecting terminal.

In addition, the invention also relates to a printed circuit board comprising the connection or connecting terminal according to the invention.

In addition, the invention also relates to a luminaire comprising the connection or connecting terminal according to the invention.

The invention will be described in more detail below with reference to embodiments, but these embodiments should be interpreted merely by way of example and not in a restrictive manner.

BRIEF DESCRIPTION OF THE DRAWINGS

The following detailed description of the preferred embodiment of the present invention will be better understood when read in conjunction with the appended drawings. For the purpose of illustrating the invention, there are shown in the drawings embodiments which are presently preferred. It is understood, however, that the invention is not limited to the precise arrangements and instrumentalities shown. In the drawings:

FIG. 1*a* shows a perspective view of a connection or connecting terminal according to the invention.

FIG. 1*b* shows a further perspective view of a connection or connecting terminal according to the invention.

FIG. 2*a* shows an exploded view of the connection or connecting terminal according to the invention shown in FIG. 1*a*.

FIG. 2*b* shows an exploded view of the connection or connecting terminal according to the invention shown in FIG. 1*b*.

FIG. 3 shows a perspective view of a connection or connecting terminal according to the invention on a printed circuit board, wherein an electrical conductor has not yet been inserted into the connection or connecting terminal.

FIG. 4*a* shows a sectional view from FIG. 3.

FIG. 4*b* shows a further sectional view A-A from FIG. 3.

DETAILED DESCRIPTION OF THE PREFERRED EMBODIMENTS

Figure 5:
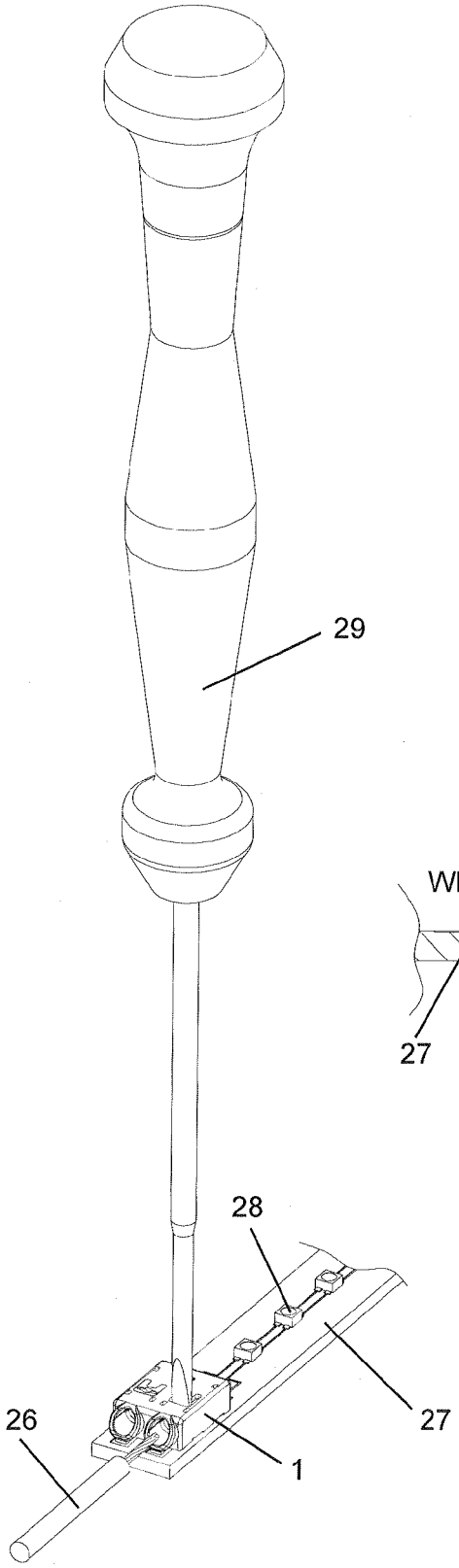
FIG. 5 shows a perspective view of a connection or connecting terminal according to the invention on a printed circuit board, wherein an electrical conductor has been inserted partially into the connection or connecting terminal.

FIG. 1*a* to FIG. 2*b* show an exemplary embodiment of a connection or connecting terminal 1 according to the invention, advantageously in the form of a screwless connection or connecting terminal.

The connection or connecting terminal 1 has a housing 2, which is in the form of an insulating body. At least one conductor insertion opening 4 is provided in the housing 2, wherein two conductor insertion openings 4 are provided in this exemplary embodiment, for preferably two conductors 26, which are not illustrated in FIGS. 1*a* and 1*b*.

Furthermore, the connection or connecting terminal 1 has at least one pushbutton 3, which acts on a punched part 5 on actuation of the pushbutton 3.

The pushbutton can preferably be actuated by a tool 29 since, owing to the small physical size of the connection or connecting terminal 1, a person skilled in the art may find it more difficult to perform actuation with his hands or fingers. The pushbutton 3 can have an actuating element 12, for example in this case in the form of an indentation for positioning a screwdriver as tool 29.

A channel 13, which acts as conductor guide for the conductor 26 when the conductor 26 is inserted into the connection or connecting terminal 1, can also be provided in the pushbutton 3.

The contact knobs 14 of the pushbutton 3 press on the spring limb 23 of the spring element 6 when the pushbutton 3 is actuated and enable opening of the spring element 6 for the insertion or removal of the conductor 26 into or out of the connection or connecting terminal 1.

The pushbutton 3 can be manufactured integrally with the housing 2, for example, and, during fitting, the pushbutton 3 can be positioned in its operating position. During fitting of the pushbutton 3, the pushbutton 3 is latched in the housing or the latching edge 30 of the pushbutton 3 is pushed into the housing 2 and finally latches in beneath the housing upper side 31. In the operating state, i.e. when the pushbutton 3 is actuated by the tool 29, the pushbutton 3 can no longer be removed from the housing 2. The latching edge 30 ensures that the pushbutton 3 cannot fall out of the housing 2.

The pushbutton 3 is arranged in the housing 2 in such a way as to be guided in the actuation direction F, with the result that it cannot tip within the housing 2 or on the punched part 5 and can transfer the pushing force completely on actuation. The pushbutton 3 acts in the same way as an elevator in the actuation direction F or in the opposite direction.

The punched part 5 is arranged in the housing 2 and forms the conductor clamping connection for the conductors 26. The punched part 5 has, inter alia, a spring element 6, as well as a contact frame 7 and contact regions 8, 9 for making electrical contact with a printed circuit board 27. A resting lug 10 is also provided on the punched part 5 in order that the conductor 26 can be held between the spring element 6 or its spring limb 23 and the resting lug 10, and contact can be made with said conductor.

Furthermore, the punched part 5 has stops 11 for the pushbutton 3 in order to limit the pushbutton travel on actuation of the pushbutton 3.

Figure 8:
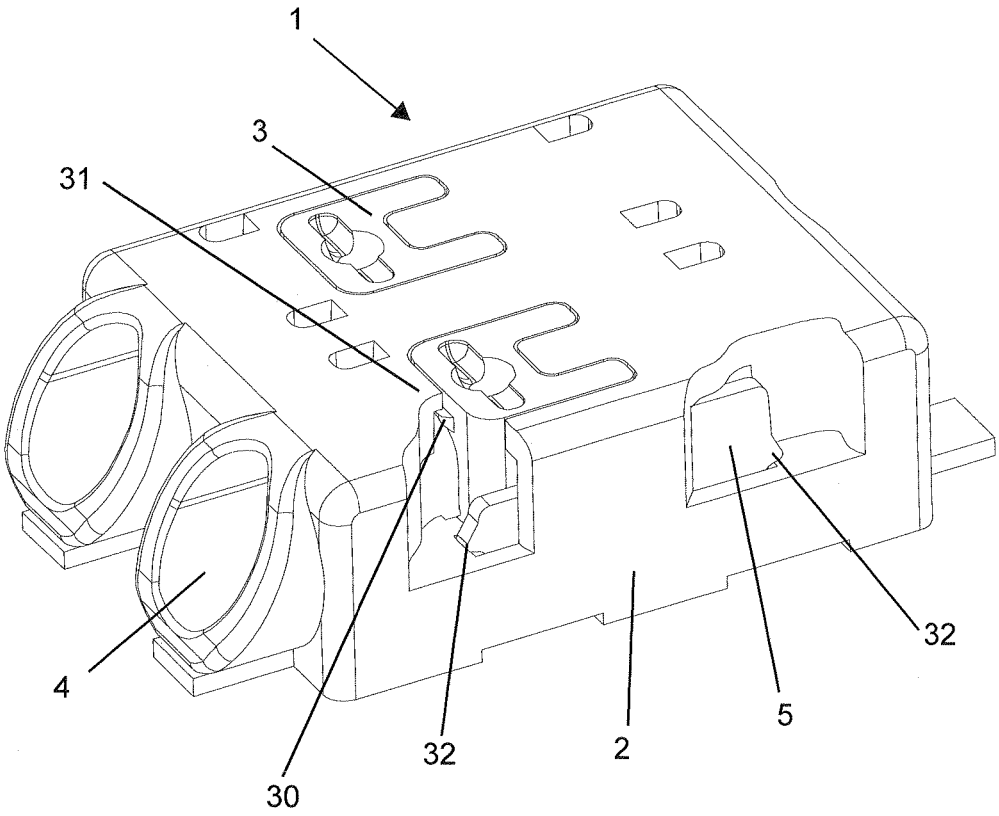
FIG. 8 shows a perspective view of a connection or connecting terminal according to the invention with a section in the housing.

The punched part 5 is arranged in the housing 2 of the connection or connecting terminal 1, wherein, when the connection or connecting terminal 1 has a plurality of conductor inlets, preferably a plurality of punched parts 5 are provided in the housing 2. The punched part 5 is provided in a chamber of the housing 2 and is positioned between the housing side walls 19 and/or housing intermediate walls 20. Preferably, latching hooks 32 which are latched in the housing 2 in order to be able to fix the punched part in the housing, as can be seen from FIG. 8, can be provided on the punched part 5.

Furthermore, the punched part 5 can have contact regions 8 and 9 at the respective ends, which can each bear on a positioning surface 21 in the region of the housing front side 17 and on a positioning surface 22 in the region of the housing rear side 18, respectively. The contact regions 8 and 9 can be used, for example, for the electrical contact with a printed circuit board 27, for example they can be soldered on the printed circuit board 27.

It is preferred for the punched part 5 to be formed from one material, wherein the material is conductive. For this purpose, it is also advantageous if the punched part 5 is formed in one piece.

FIGS. 3, 4*a* and 4*b* illustrate the state prior to actuation of the pushbutton 3, wherein the conductor 26 has not yet been inserted into the connection or connecting terminal 1.

The connection or connecting terminal 1 in the example illustrated is fixed or soldered on a printed circuit board 27. LEDs 28, which are connected to one another and to the connection or connecting terminal 1 or to the punched part 5 of the connection or connecting terminal 1 via electrical lines, are arranged on the printed circuit board 27.

In the embodiment illustrated, the punched part 5 has a spring element 6, which has an S shape.

The spring limb 23 of the spring element 6 forms the first limb of the S shape of the spring element 6 with a free end, which, in the unactuated state and without any conductors 26, bears against the contact frame 7 or against the resting lug 10 of the punched part 5 and forms the conductor clamping connection.

Furthermore, the spring element 6 has resting regions 24 and 25 owing to its shape. The resting region 24 is arranged adjacent to the spring limb 23. In the unactuated state and without any conductors 26, the resting region 24 is free in the housing 2 or is unsupported. The resting region 24 is arranged spaced apart from a mounting plate of the connection or connecting terminal 1, in this case in the form of a printed circuit board 27, by a distance X, in this state.

The resting region 25, on the other hand, acts as bearing region for the spring element 6, in this case even with the other end limb of the S-shaped spring element 6. The resting region 25 preferably bears against the housing 2, in the unactuated state, and on actuation of the pushbutton 3.

It will be conceivable for the spring element 6 to have a different shape, for example an L shape.

The pushbutton 3 is designed in such a way that, in the unactuated state and without any conductors 26, it bears against the spring limb 23 over its contact surface 15 and its contact knob 14 bears at least partially against the spring limb 23 in order to be able to transfer a direct actuation force F onto the spring element 6. The contact knob 14 of the pushbutton 3 is preferably provided closer to the resting region 24 than to the free end of the spring limb in the direction of the resting lug 10 in order to be able to ensure a more advantageous lever arm on actuation of the pushbutton 3.

In the unactuated state and without any conductors 26, the bearing surface 16 of the pushbutton 3 is arranged spaced apart from the stop 11, in this case provided on the punched part 5, by a distance $WD_{max}$, as the maximum possible pushbutton travel WD. The distance $WD_{max}$ is greater than the distance X.

Figure 6A:
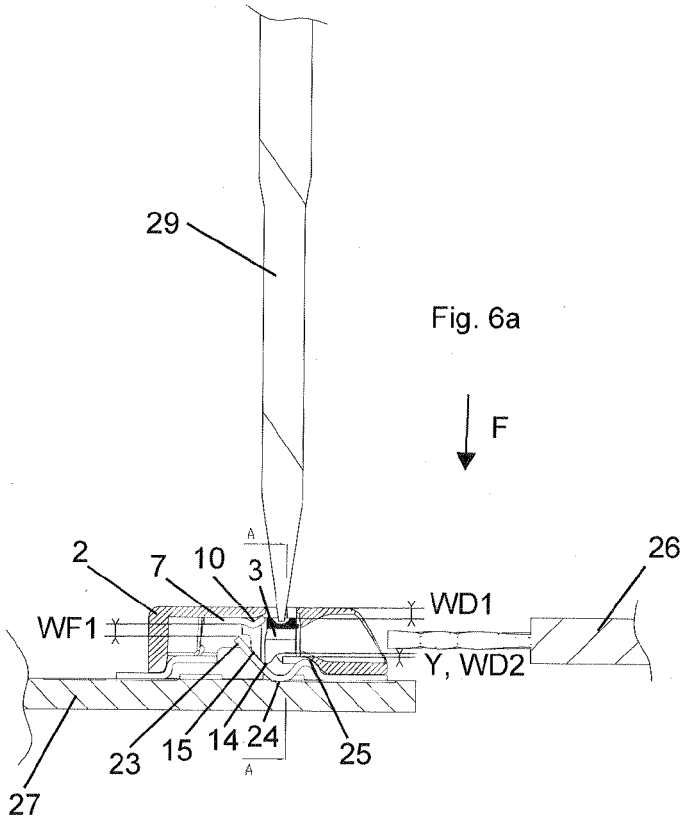
FIG. 6*a* shows a sectional view from FIG. 5.
Figure 6B:
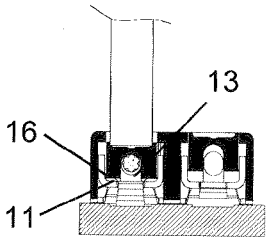
FIG. 6*b* shows a further sectional view A-A from FIG. 5.

FIGS. 5, 6*a* and 6*b* illustrate an intermediate state during actuation of the pushbutton 3. In this first subregion of the actuation of the pushbutton 3 by means of the tool 29 in the direction of the actuation force F, the pushbutton travel $WD_1$ effects an approximate uniform opening travel of the conductor clamping connection $WF_1$.

The pushbutton travel $WD_1$ and the opening travel of the conductor clamping connection $WF_1$ in this first subregion of the actuation of the pushbutton 3 are comparable with the distance X between the resting region 24 and the mounting plate of the connection or connecting terminal 1, in this case in the form of a printed circuit board 27, in the unactuated state and without any conductors, as is illustrated in FIG. 4*a*. The entire spring element 6 has been pushed in the direction of the actuation force F until the resting region 24 of the spring element 6 bears on the mounting plate of the connection or connecting terminal 1, in this case in the form of a printed circuit board 27, and can no longer be lowered any more.

At the end of this subregion, the stop surface 16 of the pushbutton 3 is still arranged spaced apart from the stop 11 of the punched part 5 by a distance Y. The distance Y is comparable to the distance $WD_{max}$ minus the distance $WD_1$.

The contact surface 15 of the pushbutton 3 preferably still bears against the spring limb 23 of the spring element 6, and the contact knob 14 of the pushbutton also bears at least partially against the spring limb 23 of the spring element 6.

Figure 7A:
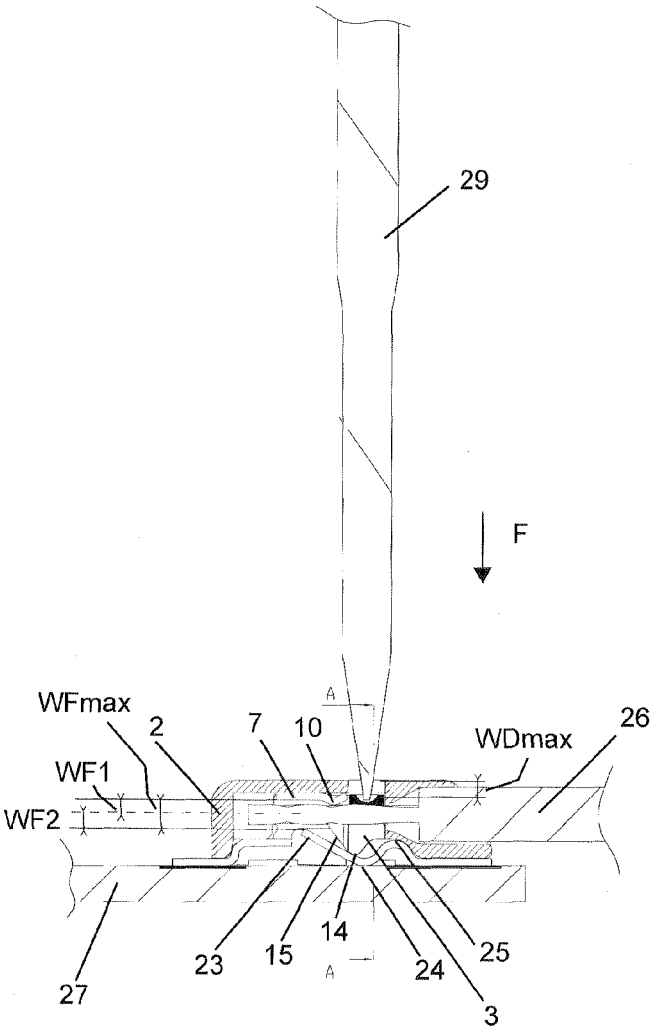
FIG. 7*a* shows a sectional view of a connection or connecting terminal according to the invention on a printed circuit board, wherein an electrical conductor has been completely inserted into the connection or connecting terminal.
Figure 7B:
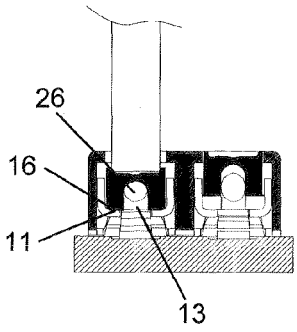
FIG. 7*b* shows a further sectional view A-A of a connection or connecting terminal according to the invention on a printed circuit board, wherein an electrical conductor has been completely inserted into the connection or connecting terminal.

FIGS. 7*a* and 7*b* illustrate the end state with the maximum actuation of the pushbutton 3, wherein the stop surface 16 of the pushbutton 3 bears on the stop 11 of the punched part 5. The pushbutton 3 has been actuated in total by its maximum pushbutton travel $WD_{max}$ by means of the tool 29 in the direction of the actuation force F.

In this second subregion of the opening travel of the conductor clamping connection, now only the spring limb 23 is pushed in the direction of the actuation force F since the other parts of the spring element 6 were already positioned in their end positions.

In the second subregion of the actuation, the pushbutton 3 is pushed over a pushbutton travel $WD_2$, wherein this pushbutton travel $WD_2$ corresponds to the distance Y after the first subregion, as is illustrated in FIG. 6*a*. The pushbutton travels $WD_1$ and $WD_2$ give the maximum pushbutton travel $WD_{max}$.

In contrast to the first subregion, the opening travel of the conductor clamping connection in the second subregion does not have a uniform behavior with respect to the pushbutton travel since only the spring limb 23 of the spring element 6 is pivoted. The position of the pushbutton 3 on the spring limb 23 of the spring element 6 effects a greater opening travel of the conductor clamping connection $WF_2$ than the pushbutton travel $WD_2$ itself. The maximum opening travel of the conductor clamping connection $WF_{max}$ corresponds to the opening travels of the conductor clamping connection $WF_1$ and $WF_2$ and is thus greater than the maximum pushbutton travel $WD_{max}$. The longer the spring limb 23 can be, the greater the opening travel of the conductor clamping connection $WF_{max}$ can become.

It is advantageous here that the physical height of the connection or connecting terminal 1 can be kept very low and nevertheless can enable a sufficient opening travel for the conductor clamping connection. The possible release travel in order to be able to insert a conductor is greater than the maximum opening travel which is provided by the pushbutton 3. For applications primarily with LEDs, it is of particular advantage since a small physical size is usually required for such products.

In this second subregion, the contact knob 14 of the pushbutton 3 passes through the punched part 5 or in the spring limb 23 of the spring element 6 or the contact knob 14 of the pushbutton 3 pushes and pivots the spring limb 23 downwards. The contact surface 15 of the pushbutton 3 no longer accompanies the movement of the spring limb 23 or no longer bears against the spring limb 23.

The conductor 26 can be inserted into the conductor insertion opening 4 in the connection or connecting terminal 1 and pushed into the conductor clamping connection. It is also advantageous if the maximum opening travel of the conductor clamping connection $WF_{max}$ is greater than the diameter of the conductor 26 to be clamped. During release of the pushbutton 3, the spring element 6 will clamp in the conductor 26 in the conductor clamping connection owing to the restoring force of said spring element.

During dismantling of the conductor 26 or in order to release the conductor 26 from the conductor clamping connection, the pushbutton 3 can be pushed in the direction of the actuation force F by means of the tool 29, even up to the maximum pushbutton travel $WD_{max}$, which will trigger actuation of the spring element 6 and in turn enable opening of the conductor clamping connection up to the maximum opening travel $WF_{max}$. The conductor 26 can then be removed from the conductor insertion opening 4.

REFERENCE SYMBOLS

1. Connection or connecting terminal
2. Housing
3. Pushbutton
4. Conductor insertion opening
5. Stamped part
6. Spring element
7. Contact frame
8. Contact region
9. Contact region
10. Resting lug
11. Stop
12. Actuating element
13. Channel
14. Contact knob
15. Contact surface
16. Stop surface
17. Housing front side
18. Housing rear side
19. Housing side wall
20. Housing intermediate wall
21. Positioning surface
22. Positioning surface
23. Spring limb
24. Resting region
25. Resting region
26. Conductor
27. Printed circuit board
28. Light emitting diode (LED)
29. Tool
30. Latching edge
31. Housing upper side
32. Latching hook
F: Actuating force
X: Distance
Y: Distance
WD: Pushbutton travel
WF: Opening travel of conductor clamping connection

What is claimed is:

1. A connection or connecting terminal (1), for electrically connecting at least one conductor (26) and at least one electrical contact body, the connection or connecting terminal (1) comprising:

a housing (2) in which the contact body is arranged, and at least one pushbutton (3), wherein the electrical contact body comprises a conductor clamping connection for the at least one electrical conductor (26), and the electrical contact body has at least one punched part (5), the at least one punched part (5) has at least one spring element (6) for the conductor clamping connection, wherein an actuation of the at least one pushbutton (3) takes effect on the at least one spring element (6) and enables opening of the conductor clamping connection, the at least one spring element (6) has an S shape or L shape, and the at least one spring element (6) has a resting region (24) which is supported on a mounting surface of the connection or connecting terminal after a partial actuation of the at least one pushbutton (3).

2. The connection or connecting terminal (1) as claimed in claim 1, further comprising a spring limb (23) forming a first limb of the at least one spring element (6).

3. The connection or connecting terminal (1) as claimed in claim 1, wherein the at least one pushbutton (3) is guided in an actuation direction (F) in the housing (2) in order to be able to prevent a tipping movement of the at least one pushbutton (3), and/or the at least one pushbutton (3) has a latching edge (30) in order to be able to prevent the at least one pushbutton (3) from falling out of the housing (2).

4. The connection or connecting terminal (1) as claimed in claim 2, wherein the at least one pushbutton (3) bears on the spring limb (23) of the spring element (6), and/or the at least one pushbutton (3) has a contact surface (15), which bears against the spring limb (23), at least in the unactuated state, and/or the at least one pushbutton (3) has a contact knob (14), which acts on the spring element (6) or passes through the punched part on actuation of the at least one pushbutton (3).

5. The connection or connecting terminal (1) as claimed in claim 1, wherein the at least one spring element (6) has a resting region (25) bearing on the housing (2).

6. The connection or connecting terminal (1) as claimed in claim 1, wherein pushbutton travel (WD) on actuation of the at least one pushbutton (3) is limited by a stop (11).

7. The connection or connecting terminal (1) as claimed in claim 1, wherein the at least one pushbutton (3) acts as conductor guide for the conductor (26).

8. The connection or connecting terminal (1) as claimed in claim 1, wherein the at least one punched part (5) is formed in one piece and/or in that the at least one punched part (5) is latched in the housing (2).

9. A printed circuit board comprising a connection or connecting terminal (1) as claimed in claim 1.

10. A luminaire comprising a connection or connecting terminal (1) as claimed in claim 1.

* * * * *